United States Patent [19]

Chappell et al.

[11] 4,322,783

[45] Mar. 30, 1982

[54] LAMP WITH IMPROVED MOUNT

[75] Inventors: Ian C. Chappell, Lexington; G. George Balog, Winchester, both of Ky.

[73] Assignee: GTE Products Corporation, Stamford, Conn.

[21] Appl. No.: 58,719

[22] Filed: Jul. 18, 1979

[51] Int. Cl.[3] ..... F21S 3/00

[52] U.S. Cl. ..... 362/217; 362/225; 362/416; 313/318; 313/219; 339/144 R

[58] Field of Search ..... 362/217, 225, 263, 267, 362/296, 306, 347, 416; 313/318, 217, 219, 220, 238, 266; 339/144 R, 50 R

[56] References Cited

U.S. PATENT DOCUMENTS 3,909,607 9/1975 Vause ..... 313/318

4,070,594 1/1978 Fuchi ..... 313/1

*Primary Examiner*—Donald P. Walsh

*Attorney, Agent, or Firm*—Edward J. Coleman

[57] ABSTRACT

A tungsten-halogen exposure lamp having a tubular envelope of quartz or high silica glass has a pinch seal at each end with a pair of stiff lead-in wires respectively extending therefrom. Attached to each lead-in wire is an open ended spade lug having a U-shaped portion laying in a plane parallel to the lamp axis. The spade lugs can be coaxially crimped about the lead-in wires. In a light source having an elongated holder with projecting mounting studs spaced from opposite ends of a cylindrical reflector, the tubular lamp is disposed along the vertex of the reflector with the pinch seals projecting through access clearances at opposite ends of the reflector with the spade lugs engaging the mounting studs.

9 Claims, 4 Drawing Figures

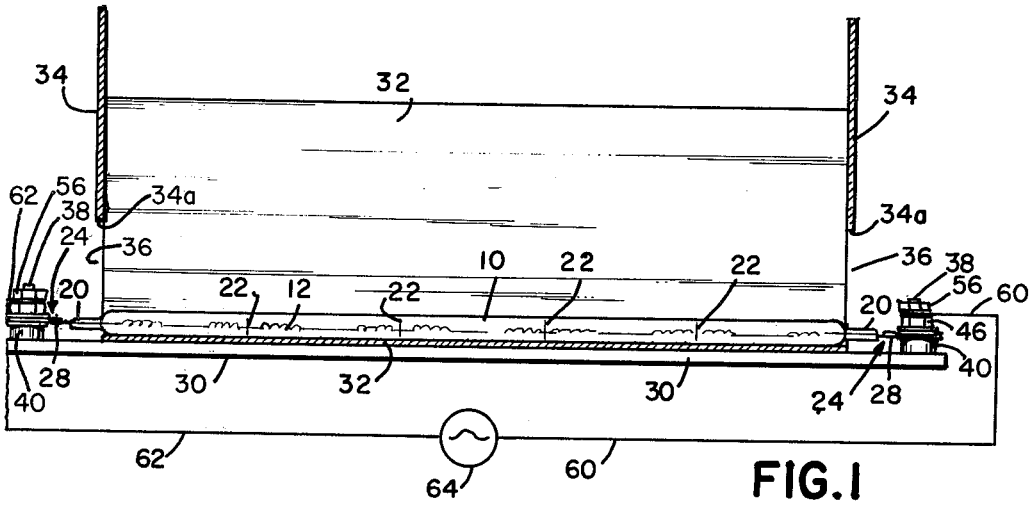
FIG. 1
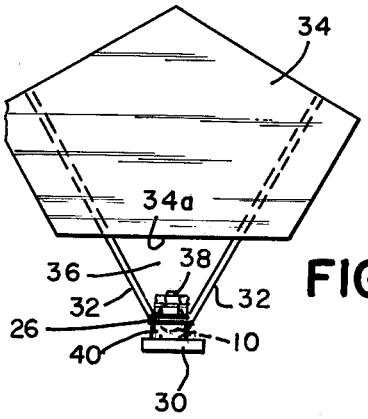
FIG. 2
FIG. 3
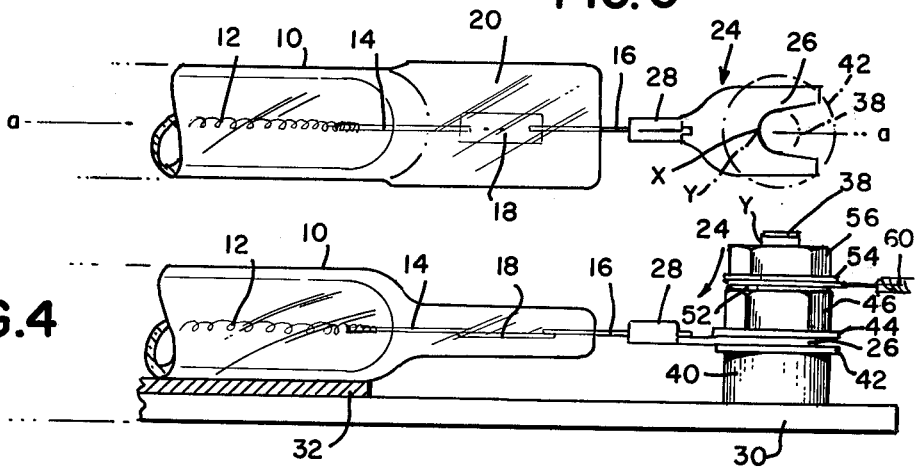
FIG. 4

LAMP WITH IMPROVED MOUNT

BACKGROUND OF THE INVENTION

This invention relates to tubular lamps having lead-in wires extending from opposite ends and, more particularly, to tungsten-halogen exposure lamps having a tubular envelope of quartz or high silica glass with mounts at opposite ends for positioning the optical alignment of the lamp in a reflector assembly.

In photocopy systems, exposure lamps are employed in the image reproduction process. Typically, such lamps have an elongated tubular envelope and are disposed along the vertex of a reflector having a partial cylindrical surface. According to a prior art type exposure light source, three such lamps were located along the reflector length with adjustable strip members, referred to as lamp shades, respectively disposed over a section of each lamp. The exposure light source further included an elongated holder to which the reflector was attached and from which projected means for mounting each lamp.

According to one prior art mounting approach, a stiff lead-in wire projecting from each end of the lamp was secured by forcing the wire end terminals into spring loaded snap-in sockets. In view of the comparatively large current carried by such lamps (e.g. greater than 9 amps), however, this mount construction would lead to sputtering at the connection area. According to another approach, threaded mounting studs projected from the holder, and closed loop spade lugs were welded to the outer ends of the lead wires at each end of the lamp. The lamp was then mounted by locating the aperture of each closed loop spade lug in alignment with the mounting stud and then dropping or forcing that end of the lamp down onto the stud prior to securing with a nut. Due to clearance constrictions in the reflector assembly, however, this mounting means proved quite awkward and, on occasion, resulted in damage to the end of the lamp.

SUMMARY OF THE INVENTION

In view of the foregoing, it is an object of this invention to provide an elongated substantially tubular lamp with an improved mounting means for more conveniently and accurately securing the position thereof.

A particular object of the invention is to provide a tungsten-halogen lamp having a tubular envelope with pinch seals at opposite ends each having a projecting lead-in wire sealed therethrough and employing improved mounting means which are more readily aligned and attached to the lead-in wires.

A further object is to provide, in a light source having a partial cylindrical reflector and projecting mounting studs, a lamp having mounting means for more conveniently and accurately positioning and securing the lamp to the studs.

These and other objects, advantages and features are attained, in accordance with the principals of this invention, by providing a lamp having an elongated substantially tubular envelope with a pair of stiff lead-in wires respectively sealed through opposite ends thereof and a pair of open-ended spade lugs respectively attached to the outer ends of the lead-in wires. Each spade lug has a substantially U-shaped portion with the open end facing away from the envelope, and the U-shaped portions of both lugs substantially lying in the same plane, which plane is substantially parallel to a plane passing through the longitudinal axis of the envelope.

According to a preferred embodiment useful in an exposure lighting application, the lamp is of a tungsten-halogen type having a substantially tubular envelope comprised of quartz or high silica glass with a pinch seal at each end. Enclosed within the sealed envelope is a halogen-containing atmosphere and a tungsten filament connected across the inner ends of the lead-in wires, which are hermetically sealed by way of respective metal foil strips through the respective pinch seals. Preferably the lead-in wires are disposed substantially coaxial with the longitudinal axis of the lamp envelope, and each of the spade lugs has a portion thereof coaxially crimped about the outer end of a respective one of the lead-in wires. The lug is aligned so that the U-shaped portion thereof is symmetrically disposed about the longitudinal axis of the lamp envelope. Such a construction has a significant manufacturing and reliability advantage over the previously employed closed loop spade lugs which were non-uniformly welded to the lead-in wires. In this previous approach, it was comparatively difficult to align the space lugs with the lead-in wires and to maintain alignment during the welding operation. As a result, incidents of improperly aligned mounting lugs would occur, leading to difficulty or damage in locating the lug apertures on their respective mounting studs. The coaxially crimped lug of the present invention offers a very significant advantage in that, during the crimping operation, the open ended lug is automatically self-aligned for assuring convenience and reliability of positioning on mounting studs.

The open-ended (U-shaped) spade lug is particularly advantageous in a light source including, an elongated holder and a reflector having a partial cylindrical surface attached to the holder, with the vertex of the reflector extending along a substantial portion of the length of the holder. Wall members are attached to each end of the reflector, with each wall member being disposed in a plane normal to the longitudinal axis of the holder and providing an access clearance between an edge of the wall member and the vertex of the reflector. An improved exposure light source is provided by replacing the three lamps previously employed in such a structure with a single elongated tubular lamp which is disposed in the cylindrical reflector along the vertex thereof with the ends of the envelope projecting through the respective access clearances at each end of the reflector. The U-shaped portions of the spade lugs are then respectively located in engagement with a pair of insulated threaded mounting studs projecting from the holder and spaced from opposite ends of the reflector. The distance between the U-shaped portions of the spade lugs and the distance between the mounting studs is substantially equal, with a tolerance no greater than 0.5 mm. In this manner, tight accurate positioning is maintained with little or no longitudinal shift of the lamp between the studs. Further, the U-shaped spade lugs permit convenient mounting of the lamp with little chance for causing damage. A service technician merely inserts the lamp through the clearance at one end of the reflector, and the open-end of the U-shaped spade lug at the opposite end of the lamp is inserted in fork-like fashion onto its corresponding mounting stud. Thereafter, the open end of the lug facing the service technician is easily slipped onto the remaining mounting stud.

BRIEF DESCRIPTION OF THE DRAWINGS

This invention will be more fully described hereinafter in conjunction with the accompanying drawings, in which:

FIG. 1 is a cross-sectional view of a light source assembly having mounted therein a lamp constructed according to the present invention the power source connection being shown schematically;

FIG. 2 is an end view of the light source assembly of FIG. 1;

FIG. 3 shows one end of a lamp having a mounting means according to the invention, the position of an aligned mounting stud and washer being shown in dashed lines; and FIG. 4 is a side view of the end of the lamp shown in FIG. 3 with additional detail being shown of the corresponding mounting structure of the light source assembly.

DESCRIPTION OF PREFERRED EMBODIMENT

Referring to the drawings, the lamp of our invention comprises an hermetically sealed light-transmitting envelope 10, which for example, may be formed of quartz or high silica glass, and which has an elongated substantially tubular configuration. The light generating means within the envelope may comprise a set of arc discharge electrodes or a filament. In the preferred embodiment of the invention now being described and illustrated, however, the lamp is of the incandescent tungsten-halogen type. Accordingly, the envelope contains a tungsten filament sectional coil 12 connected at its ends to respective lead-in conductor wires sealed through opposite ends of the lamp. Referring to FIGS. 3 and 4, which illustrate the sealed area at one end of the lamp (the opposite end of the lamp being identical thereto), the lead-in conductor arrangement comprises an inner conductor wire portion 14 and an outer conductor wire portion 16 separated in the seal area by a molybdenum foil strip 18. Wires 14 and 16 and foil strip 18 are hermetically sealed in a compressed protruding pinch seal portion 20, the pinch seals 20 being formed at opposite ends of the tubular envelope 10. The tungsten filament 12 extends axially of the tubular envelope and is connected at its ends to the inner lead wire portions 14, for example, by a few of the end turns of the filament coil being clamped around the lead wires 14. The filament 12, if desired, may be supported along its length by tungsten wire spirals 22. Typically the inner lead-in wire portions 14 are formed of tungsten wire, and the outer lead-in wire portions 16 are formed of comparatively stiff molybdenum wire, for example, wire 16 may have a diameter of about 0.75 mm. As best shown in FIGS. 3 and 4, the outer lead-in wire portions 16 extend beyond the pinch seal area 20.

As discussed above, the particular lamp shown is of the well-known halogen-cycle type, where during lamp operation a small amount of, for example, bromine vapor, functions as a getter to combine with tungsten that is vaporized from the filament 12 forming a pressure blanket of tungsten bromide allowing tungsten migration back to the vicinity of the filament where it then redeposits tungsten onto the filament and releases bromine for continuation of the cycle.

In accordance with the present invention, a pair of open-ended spade lugs 24 are attached respectively to the outer ends of the lead-in wires 16. Each of the spade lugs has a substantially U-shaped portion 26 with the open end facing away from the envelope 10. As best shown in FIG. 1, the U-shaped portions of both lugs 24 substantially lie in the same plane, which plane is substantially parallel to a plane passing through the longitudinal axis of the tubular envelope 10.

It will be noted that the lead-in wires are disposed substantially coaxial with the longitudinal axis of envelope 10 and each of the spade lugs has a portion 28 which is coaxially crimped about the outer end of a respective one of the lead-in wires 16. It is also clear, particularly when viewing FIG. 3, that each U-shaped portion 26 is symmetrically disposed about the longitudinal axis a-a of envelope 10. One example of a mounting lug 24 suitable for this application is the spade terminal available from AMP Products Corporation, Valley Forge, Pa. A particular advantage of using this symmetrical lug with a coaxial crimp mode of attachment is that, during the manufacturing assembly process of such lamps, the mounting lugs 26 may be readily attached to the lamp leads 16 in a self-aligning manner compatible with a high speed production process. This self-alignment feature of the mounting lug assures repeatable maintenance of accurate positioning of the lugs 24 with respect to the tubular lamp envelope, thus assuring accurate optical alignment of the lamp in its mounting fixture.

The improved lamp mount means of the present invention is particularly useful for accurately positioning and securing an elongated tubular lamp in a light source assembly of the type illustrated in FIGS. 1 and 2. The assembly includes an elongated holder 30 and a reflector 32 having a partial cylindrical surface attached to the holder 30 with the vertex of the reflector extending along a substantial portion of the length of the holder. The reflector 32 is constituted of a segment of a cylindrical surface which may be circular, parabolic, hyperbolic or any other optical curve, as long as it is a partial cylindrical surface. A parabolic curve is preferred in this application. Wall members 34 are attached to each end of the reflector, with each wall member being disposed in a plane normal to the longitudinal axis of the holder 30 and providing an access clearance 36 between an edge **34*a* of the wall member and the vertex of the reflector. The means for attaching the reflector 32 to holder 30 and walls 34 to the ends of the reflector may comprise welding, rivets, or the like (not shown). A pair of mounting studs 38 project upwardly from the holder 30** and are spaced from opposite ends of the reflector.

The lamp envelope 10 is disposed in the cylindrical reflector 32 along the vertex thereof, with the pinch seal ends 20 of the envelope projecting through the respective access clearances 36 at each end of the reflector, and with the U-shaped portions 26 of the spade lugs 24 respectively engaging the mounting studs 38. In this manner the tubular lamp is accurately positioned within the light source assembly. Preferably, the distance between the U-shaped portions 26, at X (FIG. 3), of the spade lugs 24 and the distance between the mounting studs 38, at Y (FIGS. 3 and 4), is substantially equal, with a tolerance no greater than 0.5 mm. so as to minimize longitudinal shifting.

In order to firmly secure this lamp mounting connection, a tubular insulating collar 40, such as of ceramic, is coaxially located on each mounting stud 38 adjacent to the holder 30. Then, as best illustrated in FIG. 4, a washer 42 is located between insulating collar 40 and the U-shaped portion 26 of the spade lug. A washer 44 is then placed on top of the spade lug, and the assembly is tightened down by a nut 46. To complete the connection assembly, another double set of washers 52, 54, may be applied on top of nut 46, with a cable terminal secured between the washers and a second nut 56 may tighten down this connection assembly. The power source cables or wires 60 and 62 (illustrated schemetically in FIG. 1) are then connected to a suitable electrical power source 64, such as AC, as illustrated, or DC or pulse (programed).

In one typical application, the assembly of FIGS. 1 and 2 is employed as an exposure light source in a photocopy machine. In such an arrangement, the mounting means of the invention is particularly useful in facilitating lamp replacement when servicing the machine. For example, keeping in mind the length of the lamp and the limited clearance space 36, and assuming access from one end of the assembly shown in FIG. 1, say the right side of the drawing, first the nuts 46 and 56 are loosened on the left side, and then the nuts and washers on the right side of the assembly are completely removed from the stud 38. The right end of the lamp is then lifted upwardly until the spade lug at that end clears the stud 38, and then the lamp is pulled outwardly to the right through the access clearance 36 on the right until the open end of the U-shaped spade lug 26 disengages from the loosened washers 42 and 44 and stud 38 on the left side. The new replacement lamp is then inserted by entering the access aperture 36 on the right side until the left end of the lamp approaches the mounting stud assembly on the left side. The left end of the lamp is projected through the access clearance 36 on the left side of the reflector, and the U-shaped spade lug on the left side is inserted between the loosened washers 42 and 44 and pushed forward until it engages the stud 38. The right end of the lamp is then lowered with the open end of the right hand U-shaped spade lug 26 aligned with stud 38 until the lamp is resting on the washer 42 supported by insulating collar 40. Next the nuts and washers are replaced on the threaded stud on the right side and tightened down, and then the loosened nuts on the left side are tightened. The assembly is complete, and the lamp is accurately aligned in position and electrically connected in circuit.

In one specific example, a tubular quartz envelope 10 was employed having a T $2\frac{1}{2}$ size; that is the outside diameter of the lamp was about $2\frac{1}{2}$ times $\frac{1}{8}$th of an inch, which is about 8 mm. The overall length of the quartz envelope 10 was about 324 mm.$\pm$1 mm. The end to end dimension of the lamp, that is from the outer tip of the left hand spade lug to the outer tip of the right hand spade lug, was about 351 mm.$\pm$1 mm. The operating voltage was 112 volts at 60 Hertz and the wattage rating was 525 watts$\pm$5%. The dimension between the mounting studs 38 was 347 mm. (center to center) and the dimension between the spade lugs at each end of the lamp was 344.5 (center to center). The outer lead wires were 0.75 mm. diameter molybdenum wire, and the spade lugs were AMP type 33713 formed of cadmium plated copper.

Although the invention has been described with respect to specific embodiments, it will be appreciated that modifications and changes may be made by those skilled in the art without departing from the true spirit and scope of the invention.

What is claimed is:

1. A lamp for mounting on an elongated holder having a pair of spaced apart mounting studs, said lamp comprising:

an elongated substantially tubular light-transmitting envelope having a seal at each end;

a pair of stiff lead-in wires respectively sealed through opposite ends of said envelope;

light generating means within said envelope, and means electrically connecting said light generating means to said lead-in wires; and a pair of open-ended spade lugs each attached to the outer end of a respective one of said lead-in wires, each of said spade lugs having a substantially U-shaped portion with the open end facing away from said envelope and being laterally engageable with a respective one of said mounting studs, said U-shaped portions of both lugs substantially lying in the same plane, which plane is substantially parallel to a plane passing through the longitudinal axis of said envelope, and the distance between the U-shaped portions of said spade lugs and the distance between said mounting studs being substantially equal, with a tolerance of no more than 0.5 millimeters.

2. A lamp according to claim 1 wherein said tubular envelope has a pinch seal at each end.

3. A lamp according to claim 2 wherein the material of said envelope is selected from group consisting of quartz and high silica glass, said light generating means comprises a tungsten filament connected across the inner ends of said lead-in wires, the atmosphere within said lamp contains a halogen, and said lead-in wires are hermetically sealed by way of respective metal foil strips through said respective pinch seals.

4. A lamp according to claim 1 wherein said lead-in wires are disposed substantially coaxial with the longitudinal axis of said envelope, each of said spade lugs has a portion thereof coaxially crimped about the outer end of a respective one of said lead-in wires, and the U-shaped portion of each of said spade lugs is symmetrically disposed about the longitudinal axis of said envelope.

5. In a light source including, an elongated holder, a reflector having a partial cylindrical surface attached to said holder with the vertex of said reflector extending along a substantial portion of the length of said holder, wall members attached to each end of said reflector, each wall member being disposed in a plane normal to the longitudinal axis of said holder and providing an access clearance between an edge of the wall member and the vertex of the reflector, and a pair of threaded mounting studs projecting from said holder and spaced from opposite ends of said reflector, a lamp comprising:

an elongated substantially tubular light-transmitting envelope having a seal at each end;

a pair of stiff lead-in wires respectively sealed through opposite ends of said envelope;

light generating means within said envelope, and means electrically connecting said light generating means to said lead-in wires; and a pair of open-ended spade lugs each attached to the outer end of a respective one of said lead-in wires, each of said spade lugs having a substantially U-shaped portion with the open end facing away from said envelope;

said envelope being disposed in said cylindrical reflector along the vertex thereof, with the ends of said envelope projecting through said respective access clearances at each end of the reflector, and with the U-shaped portion of said spade lugs respectively engaging said mounting studs; and the distance between the U-shaped portions of said spade lugs being substantially equal to the distance between said mounting studs, with a tolerance no more than 0.5 millimeters.

6. The light source of claim 5 wherein the partial cylindrical surface of said reflector is parabolic.

7. The light source of claim 5 wherein said tubular envelope has a pinch seal at each end, the material of said envelope is selected from group consisting of quartz and high silica glass, said light generating means comprises a tungsten filament connected across the inner ends of said lead-in wires, the atmosphere within said lamp contains a halogen, and said lead-in wires are hermetically sealed by way of respective metal foil strips through said respective pinch seals.

8. The light source of claim 5 wherein said U-shaped portions of both spade lugs substantially lie in the same plane, which plane is substantially parallel to a plane passing through the longitudinal axis of said envelope.

9. The light source of claim 8 wherein said lead-in wires are disposed substantially coaxial with the longitudinal axis of said envelope, each of said spade lugs has a portion thereof coaxially crimped about the outer end of a respective one of said lead-in wires, and the U-shaped portion of each of said spade lugs is symmetrically disposed about the longitudinal axis of said envelope.

* * * * *